US005908583A

United States Patent [19]

Havinga et al.

[11] Patent Number: 5,908,583

[45] Date of Patent: Jun. 1, 1999

[54] SEMICONDUCTOR POLYMER

[75] Inventors: Edsko E. Havinga, Waalre, Netherlands; Klaus A. Müllen, Köln; Thomas Soczka-Guth, Hofheim, both of Germany

[73] Assignee: U.S. Philips Corporation, New York, N.Y.

[21] Appl. No.: 08/885,004

[22] Filed: Jun. 30, 1997

[30] Foreign Application Priority Data

Jul. 9, 1996 [EP] European Pat. Off. ..... 96201919.6

[51] Int. Cl.[6] ..... H01B 1/00; H01B 1/12; C08W 3/20; C08W 69/00

[52] U.S. Cl. ..... 252/500; 252/519.34; 524/609; 524/612

[58] Field of Search ..... 252/500, 519.34; 524/609, 612

[56] References Cited

U.S. PATENT DOCUMENTS

| | | | |
|---|---|---|---|
| 3,354,129 | 11/1967 | Edmonds et al. | 260/79 |
| 4,502,980 | 3/1985 | Denisevich et al. | 252/500 |
| 4,519,937 | 5/1985 | Papir | 252/500 |
| 4,535,039 | 8/1985 | Naarmann et al. | 429/213 |
| 4,832,869 | 5/1989 | Cotts | 252/500 |

FOREIGN PATENT DOCUMENTS

| | | |
|---|---|---|
| 0 643 397 | 3/1995 | European Pat. Off. . |
| 0 717 418 | 6/1996 | European Pat. Off. . |

OTHER PUBLICATIONS

"Counter–ion induced processibility of conducting polyaniline and of conducting polyblends of polyaniline in bulk polymers", Yong Cao ET AL, 1992 —Elsevier Sequoia, Synthetic Metals, 48 (1992), pp. 91–97.

Angew. Chem., vol. 108, No. 13/14, Jul. 1996, Lixiang Wang et al, "Poly (phenylensulfidphenylenamin) (PPSA)–die Verbindung von Polyphenylensulfid mit Polyanilin", pp. 1461, 1602–1604.

*Primary Examiner*—Mark Kopec
*Assistant Examiner*—John M. Petruncio
*Attorney, Agent, or Firm*—Ernestine C. Bartlett

[57] ABSTRACT

The invention relates to a semiconducting polymer and a method of preparing a semiconducting polymer. The polymer in accordance with the invention has the repeating unit (—A—NH—B—S—), wherein A and B are conjugated groups. The polymer proves to be readily soluble already in customary organic solvents, without the groups A and B having been provided with saturated substituents, and, after doping, has an electric conductivity of approximately 1 S/cm. The method yields semiconducting polymers in accordance with the invention, which have a high molecular weight and few topological defects.

11 Claims, 1 Drawing Sheet

(1) :X=$CH_3$
(2) :X=Br
(3) :X=I
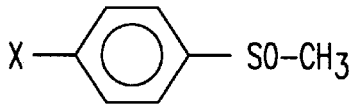
(4)
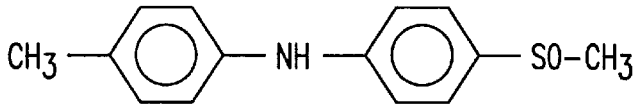
(5)
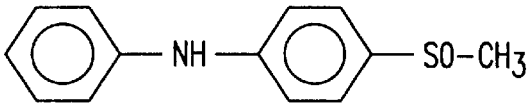
(6)
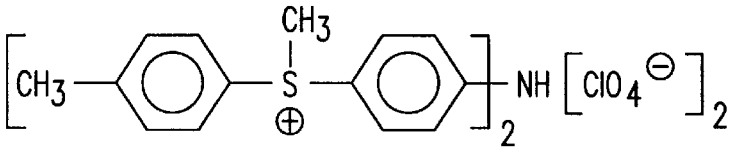
(7)
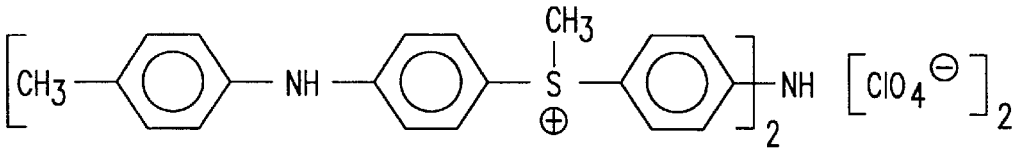
(8)
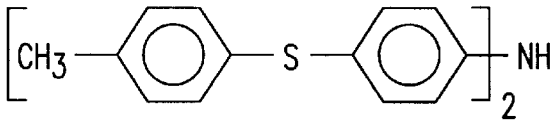
(9)
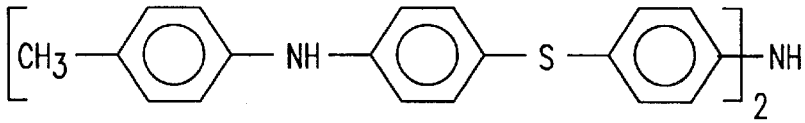
(10)
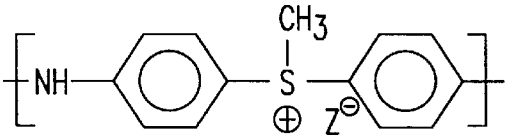
$Z^{\ominus}=CH_3SO_3^{\ominus}$
(11)
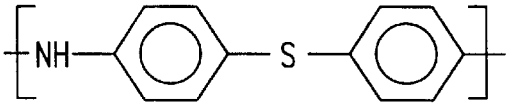

SEMICONDUCTOR POLYMER

FIELD OF THE INVENTION

The invention relates to a semiconducting polymer comprising a conjugated repeating unit.

The invention further relates to a method of preparing such a semiconducting polymer.

Semiconducting polymers can be used in many electronic and electro-optical applications. Examples of such applications are anti-static layers, "electromagnetic-shielding" layers, anti-corrosion layers, batteries, electroluminescent devices, and in electronic circuits, such as conductor tracks of transistors.

Semiconducting polymers comprise a continuous, conjugated chain of conjugated repeating units. They are also referred to as conductive or conjugated polymers, or as conductive or conjugated oligomers if the chains have a small length. By virtue of the size of the conjugated chain, the polymer can accept and/or give up electrons relatively easily. The electric conduction of the polymer can be increased by means of, for example, charge-injection of holes or electrons from electrodes or by using dopants in the form of oxidating agent or reducing agent.

BACKGROUND OF THE INVENTION

Polymers of the type mentioned in the opening paragraph are known per se. For example, in a publication by Cao et. al. in Synth. Met., 48 (1992), page 91, a description is given of the semiconducting polymer called polyaniline (PANI). Layers formed from the emeraldine salt-form of said polymer exhibit an electric conduction of up to approximately 100 S/cm when use is made of camphorsulphonic acid or dodecylbenzenesulphonic acid as the dopant. In general, the processability of the polymer is adversely affected by the presence of large conjugated chains. For example, processing, from solution, of the undoped electrically insulating form of polyaniline, i.e. the emeraldine base-form, requires the use of N-methylpyrrolidone, an amine or a strong acid, such as concentrated sulfuric acid, as the solvent. These solvents are unattractive for use on an industrial scale. Also the limited choice of solvents forms an impediment to an extensive application of these polymers. Within the art there is a need for semiconducting polymers which, despite the presence of a large conjugated system, exhibit a satisfactory solubility in customary organic solvents and, after doping, a satisfactory conductivity.

SUMMARY OF THE INVENTION

One of the objects of the invention is to meet this need. The invention more particularly aims at providing a novel, semiconducting polymer which, in undoped form, and even if it has a high molecular weight, can be readily dissolved in customary organic solvents, even in the absence of substituents linked to the conjugated chain, and which, in addition, exhibits a satisfactory conductivity in the doped form.

This object is achieved by a polymer of the type mentioned in the opening paragraph, which is characterized in accordance with the invention in that the repeating unit is chosen in accordance with the formula (—A—NH—B—S—), wherein A and B are equal or different conjugated groups (moieties). It has been found that the sulphur atoms and the nitrogen atoms, which are alternately present in the conjugated chain, give rise to a good solubility in customary organic solvents in the absence of substituents linked to the conjugated chain. Both the sulphur atom and the nitrogen atom contain a lone pair which forms part of the conjugated system, thereby forming a continuous, conjugated chain, so that a good electric conductivity is attained after doping. In a typical example, in which for A and B use was made of an unsubstituted 1,4-phenylene group, it was found that the polymer with molecular weight $M_n$ 109000 could be dissolved, up to at least 20 wt. %, in solvents such as dimethylformamide, tetrahydrofuran, N-methylpyrrolidone and dimethylacetonitrile, and it could be readily dissolved in dimethylsulphoxide. After doping with iron(III) chloride, the conductivity was 1 S/cm. It is advantageous that substituents linked to the conjugated chain are not necessary to attain a satisfactory solubility. As a result thereof, the charge transport between different chains is made easier because, on average, the distance between the chains is reduced. The fact that the choice of substituents is no longer determined by factors relating to solubility results in a greater freedom of choice of substituents, which can be used to influence other properties of the polymer. For example, by means of substituents, inter alia, the oxidation potential, the reduction potential, the absorption spectrum, the morphology of layers formed from the polymer, the compatibility with other polymers or the adhesion to certain substrates can be influenced.

In principle, the choice of the conjugated groups A and B is free, provided that they are not so large that the solubility-increasing effect of the alternating sulphur atoms and nitrogen atoms is annihilated. A group A or B is too large if, taken as a separate molecule, it cannot be dissolved in the solvent in which solubility of the corresponding polymer is desired.

A preferred embodiment of the semiconducting polymer in accordance with the invention is characterized in that A and B are chosen so as to be equal or different, with A and B being at the most a tetramer of 2,5-thienyl, 2,5-pyrryl, 1,4-phenylene or 1,4-phenylenevinylene. Polymers derived from the above-mentioned oligomers, polythiophene, polypyrrole, poly-1,4-phenylene and poly-p-phenylenevinylene are well-known polymers which, after doping, exhibit a good electric conductivity. However, if, for example, substituents which enhance the solubility are dispensed with, said polymers are insoluble in undoped form and hence intractable. By applying the above-mentioned oligomers in a polymer in accordance with the invention, however, soluble variants can be formed having a continuous, conjugated system. Since the intrinsic solubility of oligomers having more than six repeating units is unacceptably low already, the oligomer should be, at most, a tetramer.

A particular embodiment of the semiconducting polymer in accordance with the invention is characterized in that A and B are chosen so as to be equal to 1,4-phenylene. Even at molecular weights $M_n$ in excess of 100000, said polymer, i.e. poly-1,4-phenylenesulphide-1,4-phenyleneamine (PPSA) can be dissolved, up to at least 20 wt. %, in solvents such as dimethylformamide, tetrahydrofuran, N-methylpyrrolidone and dimethylacetonitrile, and said polymer can be readily dissolved in dimethylsulphoxide. Moreover, it is stable at temperatures up to 380° C. Optically clear, self-supporting layers having a modulus of elasticity of 1.3 GPa can be prepared from solution. Layers of the polymer adhere very well to metals, in particular gold. By means of known oxidating agent, PPSA can be doped to form a p-type material. Doping of a self-supporting layer of PPSA with $SbCl_5$ results in an electric conductivity of 0.18 S/cm, while doping with iron(III)chloride leads to a conductivity of 0.8 S/cm.

The invention also relates to a method of preparing such a semiconducting polymer. The method in accordance with the invention is characterized in that a sulphoxide monomer in accordance with the formula H—A—NH—B—SO—$CH_3$, wherein A is equal to an 1,4-phenylene and B is the same or a different conjugated unit, is dissolved in a strong acid, thereby forming a sulphonium polymer having the repeating unit (—A—NH—B—$S^+(CH_3)$—), which, after work up, is brought into contact with a demethylation agent, thereby forming the polymer having the repeating unit (—A—NH—B—S—). The method in accordance with the invention can very suitably be used to prepare semiconducting polymers in accordance with the invention. By virtue of the suitable choice of the starting compound H—A—NH—B—SO—$CH_3$, a polymer is formed in which the sulphur atoms and the nitrogen atoms are alternately present in the chain. The semiconducting polymers thus obtained have a well-defined structure and a high molecular weight. Unlike, for example, polyaniline obtained by oxidation of aniline, the conjugated chain is substantially free of topologic defects, and network-formation does not take place, which has a favorable effect on the solubility of the polymer and on the reproducibility of the preparation. For example, the viscosity of a polymer solution is governed substantially by the degree of network-formation.

Suitable strong acids are, for example, sulphuric acid, perfluoroalkyl sulphonic acid, alkylsulphonic acids, such as methylsulphonic acid, but preferably perchloric acid. Suitable demethylation agents are alkanolates and amines. A very suitable demethylation agent is pyridine.

The polymer in accordance with the invention can very suitably be used in optical and electronic applications, such as anti-static layers, semiconducting material in semiconductor devices, electromagnetic-shielding layers, anti-corrosion layers, batteries, electroluminescent devices and in electronic circuits, such as conductor tracks for transistors. The polymer in accordance with the invention can also suitably be used as a flame retardant, an adhesive for metals, a flocculant and a paper-reinforcing agent.

These and other aspects of the invention will be apparent from and elucidated with reference to the embodiments described hereinafter.

BRIEF DESCRIPTION OF THE DRAWINGS

In the drawings:

The sole Figure shows the structural formulas of several compounds synthesized within the framework of the invention.

DETAILED DESCRIPTION OF THE PREFERRED EMBODIMENTS

EXAMPLE 1

Synthesis of 4-Iodo-Thioanisole 4-aminothioanisole (25 g, 0.18 mol) is suspended in 100 ml of semi-concentrated sulphuric acid. An ice/salt mixture is used for slowly cooling it to 0° C., whereafter a solution of $NaNO_2$ is added at such a low rate that the temperature of the reaction mixture does not exceed 5° C. To destroy superfluous $NaNO_2$, a spatula-tipful of ureum is added and the mixture is stirred for 5 minutes. While cooling continuously and accurately controlling the temperature, a solution of sodium iodide (27 g, 0.18 mol) in 50 ml water is added dropwise in such a manner that the temperature does not exceed 5° C. After said solution has been added, the cooling means are removed and stirring is continued for 3 hours. An extraction process is carried out by means of twice 250 ml dichloromethane, whereafter the organic phase is washed with a saturated common-salt solution and dried over magnesiumsulphate. After removal of the solvent by means of a rotary film evaporator, a fractional distillation is carried out. At 80–82° C. (0.005 mbar) a quantity of 36 g (80%) of a light brown oil is obtained.

$^1$H-NMR (200 MHz, $d_6$-DMSO): 7.59, 6.98 (d, 4H, arom. $A_2B_2$-system, J(H,H=8.5 Hz), 2.44(s, 3H, $CH_3$) $^{13}$C-NMR (50 Mhz, $d_6$-DMSO): 139.1, 138.1, 128.9, 88.8, 18.2 IR (KBr, ν/[$cm^{-1}$]): 3080-2910, 1587, 1469, 1425, 1092, 801 MS (El, 70 eV, m/z): 249.9 (M, 100%), 234.8 (M—$CH_3$, 15%) Elemental analysis observed % (calculated %): ($C_7H_7SI$) C 33.60 (33.61), H 2.81 (2.82), S 12.64 (12.79), I 50.49 (50.78)

EXAMPLE 2

Synthesis of 4-Toluenemethylsulphoxide (Formula 1)

In a 250 ml Erlenmeyer flask, ammoniumcerium(VI) nitrate (27.5 g, 50 mmol) is dissolved in 150 ml acetonitrile. After the addition of 50 ml water, 12.5 mmol 4-methylthioanisole is added and the reaction mixture is stirred for 3 minutes at room temperature. The reaction mixture is poured onto 500 ml of water and extracted, in succession, with diethylether (2×100 ml) and with chloroform (100 ml). The united organic phases are dried with magnesium sulphate and the solvent is removed by means of a rotary film evaporator. The purity of the product thus obtained in accordance with formula 1 (yield 70–80%) is sufficient for the following conversions. Samples of analytical purity can be obtained from ethanol by recrystallization.

$^1$H-NMR (200 MHz, $CDCl_3$): 7.76, 7.38 (4H, arom. $A_2B_2$-system, J(H,H=7.9 Hz), 2.73(3H,S(O)—$CH_3$), 2.49 (3H,—$CH_3$) $^{13}$C-NMR (50 Mhz, $d_6$-DMSO): 146.3, 145.5, 130.7, 124.4, 43.3, 22.3 IR (KBr, ν/[$cm^{-1}$]): 3051-2920, 1596, 1498, 1458, 1041, 813 MS (El, 70 eV, m/z): 150.0 (M, 77%), 138.9 (M—$CH_3$, 100%) Elemental analysis observed % (calculated %): ($C_8H_{10}OS$) C 62.05 (62.30), H 6.59 (6.54), S 21.01 (20.79)

Synthesis of 4-Bromophenylmethylsulphoxide (Formula 2)

This synthesis is analogous to that of 4-toluenemethylsulphoxide, with this difference that 4-methylthioanisole is replaced by 4-bromothioanisole.

$^1$H-NMR (200 MHz, $d_6$-DMSO): 7.80, 7.65 (d, 4H, arom. $A_2B_2$-system, J(H,H=8.3 Hz), 2.73(s, 3H, $CH_3$) $^{13}$C-NMR (50 Mhz, $d_6$-DMSO): 146.2, 134.2, 126.1, 124.4, 43.4 IR (KBr, ν/[$cm^{-1}$]): 3000-2910, 1570, 1471, 1458, 1043, 817 MS (El, 70 eV, m/z): 219.8 (M, 70%), 204.7 (M—$CH_3$, 100%) Elemental analysis observed % (calculated %): ($C_7H_7OSBr$) C 38.47 (38.37), H 3.32 (3.22) S 14.80 (14.63), Br 36.53 (36.47)

Synthesis of 4-Iodophenylmethylsulphoxide (Formula 3)

This synthesis is analogous to that of 4-toluenemethylsulphoxide, with this difference that 4-methylthioanisole is replaced by 4-iodothioanisole.

$^1$H-NMR (200 MHz,$d_6$-DMSO): 7.96, 7.48 (d, 4H, arom. $A_2B_2$-system, J(H,H=8.4 Hz), 2.74(s, 3H, S(O)—$CH_3$) $^{13}$C-NMR (50 MHz, $d_6$-DMSO): 146.7, 138.2, 125.9, 97.9, 43.4 IR (KBr, ν/[$cm^{-1}$]): 2990-2910, 1570, 1469, 1420, 1036, 811 MS (El, 70 eV, m/z): 265.9 (M, 78%), 250.7 (M—$CH_3$, 100%) Elemental analysis observed % (calculated %): ($C_7H_7OSI$) C 31.60 (31.59), H 2.63 (2.65), S 12.02 (12.02), I 47.92 (47.69)

EXAMPLE 3

Synthesis of 4-Methylsulphoxy-Phenyltolylamine (Formula 4)

In a 100 ml round-bottom flask, a quantity of 30 mmol 4-bromo or 4-iodophenylmethylsulphoxide and 63 mmol toluidine as well as potassium carbonate (4.0 g) and copper (I)iodide (0.67 g, 3.5 mmol) are heated at 190° C. in 50ml of dry 1,3-dimethyltetrahydro-2(1H)-pyrimidinone for 18 hours in an inert gas. After cooling, the reaction mixture is poured into water and extracted with dichloromethane (3×100 ml). The united organic phases are washed with 100 ml water and dried over magnesium sulphate.

The solvent is removed by means of a rotary film evaporator (towards the end by evacuating using an oil pump). The remaining black oil is chromatographed ($R_f$ 0.67) over silica gel with ethylacetate/methanol (35:1). The yield of the process ranges from 35 to 45% and consists of a beige microcrystalline solid material in accordance with formula 4.

$^1$H-NMR (200 MHz, $d_6$-DMSO): 7.42 (d, 2H, arom., J(H,H)=8.5 Hz), 7.06-6.98 (m. 6H, arom.), 2.63 (s, 3H, SO—$CH_3$), 2.828 (s, 3H, —$CH_3$) $^{13}$C-NMR (50 MHz, $d_6$-DMSO): 148.5, 139.2, 133.8, 132.9, 130.4, 126.1, 121.3, 115.9, 44.0, 21.3 IR (KBr, ν/[$cm^{-1}$]): 3265, 3150-2810, 1592, 1531, 1497, 1343, 1034, 808 MS (FD, m/z): 245.4 Elemental analysis observed %, (calculated %): ($C_{14}H_{15}NOS$, 245.1) C 68.31 (68.55), H 6.15 (6.17), N 5.52 (5.71), S 13.14 (13.05)

Synthesis of 4-Methylsulphoxy-Diphenylamine (Formula 5)

This synthesis is analogous to that of 4-methylsulphoxy-phenyltolylamine (formula 4), with this difference that aniline is used instead of toluidine.

$^{13}$C-NMR (50 MHz, $d_6$-DMSO): 115.8, 118.8, 121.5, 125.7, 129.8, 135.0, 142.3, 146.8, 43.5 MS (FD, m/z): 231.4 Elemental analysis observed %, (calculated %): ($C_{13}H_{13}ONS$, 231.1) C 67.53 (67.50), H 5.65 (5.66), N 6.04 (6.06), S 13.88 (13.86)

EXAMPLE 4

Synthesis of 4,4'-Di(4-Methylsulphoniumtolyl) Diphenylamine Perchlorate (Formula 6)

A quantity of 10 mmol of 4-toluenemethylsulphoxide 1 is stirred with diphenylamine (0.854 g, 5 mmol) in 15 ml perchloric acid (70%) for 48 hours at room temperature while excluding moisture. The mixture obtained is slowly poured into ice-cold water and stirred for 3 hours. Subsequently, the mixture is drawn off and washed with water and abundant methanol. After drying in a vacuum created by means of an oil-pump, a yield of 90 to 98% of the desired perchlorate is obtained in the form of a colorless microcrystalline compound in accordance with formula 6.

$^1$H-NMR (200 MHz, $d_6$-DMSO): 9.58 (s, 1H, NH), 7.92, 7.93 (d, 4H. arom. $A_2B_2$-System, J(H,H)=8.7 Hz), 7.91, 7,54 (d. 4H, arom. $A_2B_2$-System, J(H,H)=8.4 Hz), 3.73 (s, 6H, S—$CH_3$) $^{13}$C-NMR (50 MHz, $d_6$-DMSO): 146.6, 144.6, 132.1, 131.5, 129.6, 125.3, 118.8, 116.8, 27.5, 21.2 IR(KBr, ν/[$cm^{-1}$]): 3630-3248, 3240-2930, 1587, 1493, 1342, 809 UV/VIS (DMF (6% $HCLO_4$), $\lambda_{max}$ (ε)): 343 nm (42000) Elemental analysis observed %, (calculated %): ($C_{28}H_{29}NS_2O_8Cl_2$): C 52.18 (52.34), H 4.86 (4.55), N 2.13 (2.18), S 9.21 (9.98), Cl 11.60 (11.03)

Synthesis of 4,4'-Di(4-Methyl-4'-Methylsulphoniumdiphenylamine)Diphenylamine Perchlorate (Formula 7)

A quantity of 10 mmol of 4-methylsulphoxy-phenyltolylamine 4 is stirred with diphenylamine (0.845 g, 5 mmol) into 15 ml of perchloric acid (70%) for 48 hours at room temperature while excluding moisture. The mixture is slowly poured into ice-cold water and stirred for 3 hours, whereafter it is drawn off and, subsequently, washed with water and abundant methanol. After drying in a vacuum created by means of an oil-pump, a yield of 90 to 98% of the desired perchlorate is obtained in the form of a colorless microcrystalline compound in accordance with formula 7.

$^1$H-NMR (200 MHz, $d_6$-DMSO): 9.52 (s, 1H, NH), 8.87 (s, 2H, NH), 7.90-7.75 (m, 8H, arom.), 7.40-7.36 (m, 4H, arom.), 7.20-7.06 (m, 12H, arom.), 3.65 (s, 6H, S—$CH_3$), 2.29 (s, 6H, —$CH_3$) $^{13}$C-NMR 50 MHz, $d_6$-DMSO): 150.1, 148.4, 137.9, 132.6, 131.9, 131.3, 130.2, 121.2, 118.7, 118.4, 115.3, 112.2, 28.1, 20.7 IR(KBr, ν/[$cm^{-1}$]): 3355; 3267-2855; 1588, 1494; 1339; 820 UV/VIS (DMF (6% $HCLO_4$), $\lambda_{max}$ (ε)): 350 nm (57900) Elemental analysis observed %, (calculated %): ($C_{40}H_{39}N_3S_2Cl_2O_8$) C 57.33 (58.25), H 4.89 (4.77), N 4.79 (5.09), S 8.86 (7.77), Cl 8.53 (8.60)

EXAMPLE 5

Synthesis of 4,4'-Di(4-Toluene-Sulphide) Diphenylamine (Formula 8)

A quantity of 7.5 mmol of the sulphonium compound 6 is introduced into 25 ml of dry pyridine and refluxed in argon for 5 hours. After cooling, the mixture is poured onto 100 ml of ice-cold water and stirred for some time. If desirable, the precipitate can be converted to a more compact form by adding a few drops of hydrochloric acid. Subsequently, the product is filtered off and washed with water and abundant methanol. A yield of 95–98% of the desired product 8 is obtained in the form of a colorless to grey micro-crystalline powder in accordance with formula 8.

$^1$H-NMR (200 MHz, $d_6$-DMSO): 8.58 (s, 1H, NH), 7.31, 7.12 (d, 4H, arom. $A_2B_2$-System, J(H,H)=8.5 Hz), 7.14 (m, 4H, arom.), 2.27 (s, 6H, —$CH_3$) $^{13}$C-NMR (50 MHz, $d_6$-DMSO): 143.2, 136.1, 134.3, 134.1, 130.1, 129.2, 123.5, 118.1, 20.8 IR (KBr, ν/[$cm^{-1}$]): 3413, 3020-2850, 1594, 1491, 1502, 1302, 810 UV/VIS (DMF, $\lambda_{max}$ (ε)): 315 nm (38300) MS (FD, m/z): 413.5 (M, 100%) Elemental analysis observed %, (calculated %): ($C_{26}H_{23}NS_2$, 413.6) C 75.69 (75.51), H 5.65 (5.51), N 3.30 (3.39), S 15.65 (15.50)

Synthesis of 4,4'-Di(4-Methyl-4'-Diphenylaminesulphide) Diphenylamine (Formula 9)

This synthesis is analogous to that of 4,4'-di(4-toluene-sulphide)diphenylamine (formula 8), with this difference that the sulphonium compound in accordance with formula 7 is used instead of the sulphonium compound in accordance with formula 6.

$^1$H-NMR (200 MHz, $d_6$DMSO): 8.37 (s, 1H, NH), 8.15 (s, 2H, NH), 7.24-7.16 (m, 8H, arom.), 7.10-6.97 (m, 16H, arom.), 2.24 (s, 6H, —$CH_3$) $^{13}$C-NMR (50 MHz, $d_6$-DMSO): 144.3, 142.5, 140.2, 133.3, 131.9, 129.9, 129.8, 126.5, 123.5, 118.6, 117.9, 116.5, 20.58 IR (KBr, ν/[$cm^{-1}$]): 3410, 3030-2910, 1594, 1517, 1494, 1517, 1311, 820 UV/VIS (DMF, $\lambda_{max}$ (ε)): 318 nm (62300) MS (FD, m/z): 595.7 (M, 100%) Elemental analysis observed %, (calculated %): ($C_{38}H_{33}N_3S_2$, 595.8) C 76.60 (76.60), H 5.46 (5.58), N 6.93 (7.05), S 11.01 (10.76)

EXAMPLE 6

Synthesis of Poly(1,4-Phenylene-Methylsulphonium-1,4-Phenyleneamine) methylsulphonate (Formula 10)

4-methylsulphoxy-diphenylamine (formula 5) (2 g, 9.6 mmol) is dissolved in 30 ml methylsulphonic acid and stirred at room temperature for 24 hours. The reaction mixture is slowly poured into ice water and stirred overnight. This leads to discoloration from reddish blue to colorless. The product is filtered off and washed with abundant water. The resultant polymer having a repeating unit in accordance with formula 10 is dried in a vacuum created by means of an oil-pump for 48 hours at 50° C.

The analyses of the product were carried out by means of the perchlorate of compound 10 because this salt could more easily be obtained in a defined form.

$^1$H-NMR (200 MHz, $d_6$-DMSO): 9.58 (s, 1H, NH), 7.95, 7.41 (d, 4H, arom. $A_2B_2$-System, J(H,H)=8.7 Hz), 3.70 (s, 3H, S—$CH_3$) $^{13}$C-NMR (50 MHz, $d_6$-DMSO): 146.6, 131.8, 118.7, 117.4, 117.4, 24.0 IR (KBr, ν/[$cm^{-1}$]): 3441, 3275-2810, 1573, 1491, 1334, 820 Elemental analysis observed %, (calculated %): ($C_{13}H_{12}NSClO_4$, (313.8)) C 48.61 (49.77), H 4.07 (3.86), N 4.36 (4.46), S 10.53 (10.22), Cl 11.0 (11.30)

EXAMPLE 7

Synthesis of Poly(1,4-Phenylenesulphide-1,4-Phenyleneamine) (Formula 11)

Poly(1,4-phenylene-methylsulphonium-1,4-phenyleneamine)methylsulphonate 10 (1.5 g) is heated in 50 ml of dried pyridine for 6 hours while it is being refluxed. The clear solution is cooled and then poured into water and stirred for several hours at 50° C. The resultant colorless polymer having a repeating unit in accordance with formula 11 (1.25 g, 94–98%) is filtered off, washed with abundant water and methanol and dried in a vacuum created by means of an oil-pump.

$^1$H-NMR (200 MHz, $d_6$-DMSO): 8.41 (s, 1H, NH), 7.03, 7.21 (d, 4H, arom. $A_2B_2$-System, J (H,H)=9.2 Hz) $^{13}$C-NMR (50 MHz, $d_6$-DMSO): 142.7, 132.8, 125.7, 118.0 IR (KBr, ν/[$cm^{-1}$]): 3390, 3250-2810, 1581, 1490, 1439, 1318, 1083, 815 UV/VIS (DMF, $\lambda_{max}$ (ε)): 332 nm (25300) GPC (THF, PS-calibration): $M_n$=119.000 g $mol^{-1}$, $M_w$=206.000 g $mol^{-1}$ Membrane osmometry (DMF, cut-off 5000 g $mol^{-1}$): $M_n$=110.000 g $mol^{-1}$, n=545 Elemental analysis observed %, (calculated %): (($C_{12}H_9NS)_n$, $(199.1)_n$) C 72.46 (72.35), H 4.63 (4.85), N 6.88 (7.04), S 16.21 (16.06).

We claim:

1. A semiconducting polymer comprising a conjugated repeating unit, wherein the repeating unit is chosen in accordance with the formula —A—NH—B—S—), wherein A and B are equal or different conjugated moieties.

2. A semiconducting polymer as claimed in claim 1, wherein A and B are chosen so as to be equal or different, with A and B being at the most a tetramer of 2,5-thienyl, 2,5-pyrryl, 1,4-phenylene or 1,4-phenylenevinylene.

3. A semiconducting polymer as claimed in claim 2, wherein A and B are chosen so as to be equal to 1,4-phenylene.

4. A method of preparing a semiconducting polymer comprising a conjugated repeating unit chosen in accordance with the formula (—A—NH—B—S—), wherein A and B are equal or different conjugated moieties, which method comprises dissolving a sulphoxide monomer having the formula H—A—NH—B—SO—$CH_3$, wherein A is a 1,4-phenylene and B is the same or a different conjugated moiety in a strong acid to form a sulphonium polymer having the repeating unit (—A—NH—B—$S^+(CH_3)$—), and contacting said sulphonium polymer with a demethylation agent, to form a polymer having the repeating unit (—A—NH—B—S—).

5. A semiconducting polymer comprising a conjugated repeating unit chosen in accordance with the formula (A—NH—B—S—), wherein A and B are chosen to be a poly(1,4-phenylenesulphide-1,4-phenyleneamine)polymer.

6. A semiconducting polymer comprising a conjugated repeating unit chosen in accordance with the formula (A—NH—B—S—), wherein A and B are chosen to be a poly(1,4-phenylene-methylsulphonium-1,4-phenyleneamine) methylsulphonate polymer.

7. A semiconducting polymer comprising a conjugated repeating unit chosen in accordance with the formula (A—NH—B—S—), wherein A and B are equal or different conjugated moieties, said polymer being capable of being dissolved, in the absence of substituents linked to the conjugated chain, at least up to 20 wt. %, in organic solvents selected from the group of dimethylformamide, tetrahydrofuran, N-methylpyrrolidone, dimethylacetonitrile, and dimethylsulphoxide.

8. A method as claimed in claim 4, wherein the strong acid is selected from the group of sulphuric acid, perfluoroalkyl sulphonic acid, alkylsulphonic acids, and perchloric acid.

9. A method as claimed in claim 4, wherein the demethylation agent is an alkanolate or an amine.

10. A method as claimed in claim 8, wherein said acid is perchloric acid.

11. A method as claimed in claim 9, wherein said demethylation agent is pyridine.

* * * * *